US010731656B2

(12) United States Patent
Huber

(10) Patent No.: US 10,731,656 B2
(45) Date of Patent: Aug. 4, 2020

(54) SELF-ADJUSTING DRUM SYSTEM

(71) Applicant: Xylem IP Management S.à.r.l., Senningerberg (LU)

(72) Inventor: Gottfried Huber, Guntersdorf (AT)

(73) Assignee: XYLEM EUROPE GMBH, Schaffhausen (CH)

( * ) Notice: Subject to any disclaimer, the term of this patent is extended or adjusted under 35 U.S.C. 154(b) by 129 days.

(21) Appl. No.: 16/000,556

(22) Filed: Jun. 5, 2018

(65) Prior Publication Data

US 2018/0355879 A1 Dec. 13, 2018

(30) Foreign Application Priority Data

Jun. 9, 2017 (EP) ..... 17175321

(51) Int. Cl.
*F04D 29/041* (2006.01)
*F04D 29/047* (2006.01)
*F04D 1/06* (2006.01)
*F04D 29/12* (2006.01)

(52) U.S. Cl.
CPC ..... *F04D 29/0416* (2013.01); *F04D 1/06* (2013.01); *F04D 29/0473* (2013.01); *F04D 29/126* (2013.01); *F05D 2240/52* (2013.01); *F05D 2240/53* (2013.01)

(58) Field of Classification Search
CPC ..... F01D 25/162; F01D 25/30; F01D 25/005; F01D 25/243; F04D 29/0516; F04D 29/0416; F04D 1/06; F04D 29/0473; F04D 29/126; F05D 2240/52
USPC ..... 415/104
See application file for complete search history.

(56) References Cited

U.S. PATENT DOCUMENTS 2,221,225 A * 11/1940 Weis ..... F04D 29/126 277/388
3,393,947 A * 7/1968 Sandy, Jr. ..... F16C 17/04 384/303
4,337,951 A * 7/1982 Perego ..... F01D 11/00 277/415
4,493,610 A 1/1985 Iino et al.
(Continued)

OTHER PUBLICATIONS

Extended European Search Report dated Nov. 30, 2017 re: Application No. EP 17175321.3, pp. 1-5, citing: U.S. Pat. No. 8,133,007 B2, U.S. Pat. No. 4,493,610 A, U.S. Pat. No. 5,713,720 A and U.S. Pat. No. 5,302,091 A.

*Primary Examiner* — Igor Kershteyn
*Assistant Examiner* — Andrew Thanh Bui
(74) *Attorney, Agent, or Firm* — Cantor Colburn LLP

(57) ABSTRACT

A self-adjusting drum system for use with a pump or similar rotating machinery includes a balancing drum mounted on a central shaft for joint rotation therewith. The shaft extends along an axial direction and the balancing drum has an outer surface. A fixed, stationary structure surrounding the balancing drum is provided. The stationary structure has an inner surface arranged so as to face the outer surface of the balancing drum, and an annular gap is provided therebetween. A bush element is arranged in the annular gap so as to leave clearance with respect to the inner and/or outer surfaces. A fixing component is further provided for fixing the bush element to the stationary structure so as to lock the bush element against movement along the axial direction and allow it to freely move along a radial direction, inside the annular gap.

13 Claims, 2 Drawing Sheets

(56) References Cited

U.S. PATENT DOCUMENTS

| | | | | |
|---|---|---|---|---|
| 5,302,091 | A | 4/1994 | Horiuchi | |
| 5,713,720 | A | 2/1998 | Barhoum | |
| 6,568,901 | B2 * | 5/2003 | Wang | F04D 29/0413 415/104 |
| 8,133,007 | B2 | 3/2012 | Marcelli | |

* cited by examiner

SELF-ADJUSTING DRUM SYSTEM

CROSS-REFERENCED TO RELATED APPLICATIONS

This application is related to, and claims the benefit of, European Patent Application No. 17175321.3, filed on Jun. 9, 2017, the contents of which are herein incorporated by reference in their entirety.

TECHNICAL FIELD

The present disclosure relates to a self-adjusting drum system suitable for use with pumps, in particular centrifugal pumps as for instance multistage centrifugal pumps or similar rotating machinery.

BACKGROUND

Reliability of rotating machinery, especially of above mentioned pumps, is defined on account of wear rate of the components and the bearing durability.

One of the important performance parameters for any centrifugal pump is its bearing life.

High pressure liquid in a pump exerts pressure on the outlet passages and shroud of the impeller, resulting in the generation of two forces, one in a lateral or radial direction and another in a longitudinal or axial direction with respect to the shaft axis.

The bearing life of a centrifugal pump depends upon the two hydraulic forces acting on the impeller, i. e. radial thrust and axial thrust.

Thrust balancing systems for centrifugal pumps are known in the art which have been devised to mitigate the effects of thrust on the bearings.

In a known balancing drum system, an axial load is transmitted to a balancing drum coupled to the pump shaft rotating in a static bush arrangement in the pump body cavity with a minimum radial clearance.

Fluid in the clearance forms a thin film that performs a useful bearing function, like a film of lubricant formed on a journal bearing.

In accordance with the known art, the radial clearance between the balancing drum and the bushing arrangement cannot be lowered below a set minimum value.

However, fluid leaking through the clearance amounts to a flow rate that may reduce the pump efficiency.

An axial thrust balancing system is known from U.S. Pat. No. 4,493,610.

Such axial thrust balancing system comprises a rotary shaft having an impeller mounted thereon. A sleeve is secured to the rotary shaft on the discharge side of the impeller for idle movement in an axial direction together with the rotary shaft.

A bush is fixedly attached to a casing enclosing the sleeve, juxtaposed against the sleeve with an annular clearance defined between the sleeve and the bush.

To solve the problem of too much fluid leaking through the annular clearance, the clearance is divided axially, by way of pressure chambers, into a plurality of shorter annular clearances formed between the sleeve and the bush that have the purpose of preventing an increase of the fluid flow rate.

Another axial thrust balancing system is known from U.S. Pat. No. 8,133,007.

The document discloses a multiple-stage centrifugal pump including a drum balancing device for eliminating unstable operations of the pump and reducing to a minimum the axial reactive force.

A leakage system is disclosed in the document making it possible to control and limit pump flow rate losses, thereby providing an improved efficiency pump.

The system is constituted by a controlled leakage hydraulic balancing drum coupled on a pump shaft and turning with a minimum radial clearance in a pump body or in a bush arrangement fixedly mounted on said pump body. A rotary ring element mounted on the balancing drum and rotatively driven therewith is arranged for only axial movement between the balancing drum and a fixed ring element mounted on said pump body. The rotary ring element has an end portion, forming with the fixed ring element a narrowing portion allowing the passage of leakage flow. Springs are provided which press the rotary ring element axially against the fixed ring element.

The balancing drum has a diameter such as to allow the control of the axial balancing force of the rotor of the pump. The rotary ring is hydraulically balanced so as to define a set leakage loss.

While the above arrangements may prove useful to provide leakage loss control through the clearance between the drum and the body of the pump, there is still a need for a simple and reliable leakage control system.

SUMMARY OF THE DISCLOSURE

Accordingly, the aim of the present disclosure is to provide a self-adjusting drum system for use with a pump, preferably a multi-stage centrifugal pump or similar rotating machinery, and a pump using same, adapted to greatly improve bearing durability by providing in an automatic manner optimum bearing characteristics of a fluid film formed in the clearance between a balancing drum and the bushing arrangement.

Within this aim, the present disclosure provides a self-adjusting drum system for use with a pump and a pump using same, adapted to reduce flow leakage in the clearance between a balancing drum and the bushing arrangement, thereby maintaining high pump efficiency.

The present disclosure also provides a self-adjusting drum system for use with a pump and a pump using same, that is of simple construction and highly reliable in use.

The present disclosure further provides a self-adjusting drum system for use with a pump and a pump using same, that can be efficiently provided for any type of pump including centrifugal pumps, notwithstanding its field of application, using materials that are usual in the technical field of application.

These advantages which will become better apparent hereinafter are achieved by providing a self-adjusting drum system for use with a pump having the features set forth in claim 1 and by a pump comprising a self-adjusting drum system, as set forth in claim 7.

The self-adjusting drum system for use with a pump according to the disclosure, may comprise, in a preferred but not exclusive embodiment, a balancing drum mounted on a central shaft for joint rotation therewith, said shaft extending along an axial direction, said balancing drum having an outer surface thereof; a fixed, stationary structure surrounding said balancing drum, said stationary structure having an inner surface arranged so as to face said outer surface of the balancing drum with an annular gap being provided therebetween; a bush element arranged in said annular gap so as to leave clearance with respect to said inner and/or outer surfaces; and fixing means for fixing said bush element to said stationary structure so as to lock the bush element against movement along the axial direction and allow it to freely move along a radial direction and/or allow it to tilt with respect to the axial direction, inside said annular gap.

A pump comprising the self-adjusting drum system according to the disclosure can have the central shaft, on which the balancing drum is mounted, supporting thereon an impeller of the pump, the stationary structure being a casing or part of a casing of the pump.

In the multi-stage centrifugal pump, according to the disclosure, when pressurized fluid is flowed inside the annular gap formed between the outer surface of the balancing drum and the inner surface of the bush element, the bush element arranges itself in a hydrostatically centered position inside said annular gap, by way of radial movement along said radial direction or a tilting movement relative to the axial direction, so as to provide, during pump operation, the minimum clearance sufficient for free rotation of the drum.

BRIEF DESCRIPTION OF THE DRAWINGS

Further characteristics and advantages of the present disclosure will become better apparent hereinafter from the following disclosure of a preferred, but not exclusive, embodiments of the system and pump according to the disclosure, which is illustrated by way of non-limiting example in the accompanying drawings, wherein.

In the accompanying drawings, to which reference will be made hereinafter, like numerals are used to designate like elements throughout the various figures.

DETAILED DESCRIPTION OF THE DRAWINGS

Figure 1:
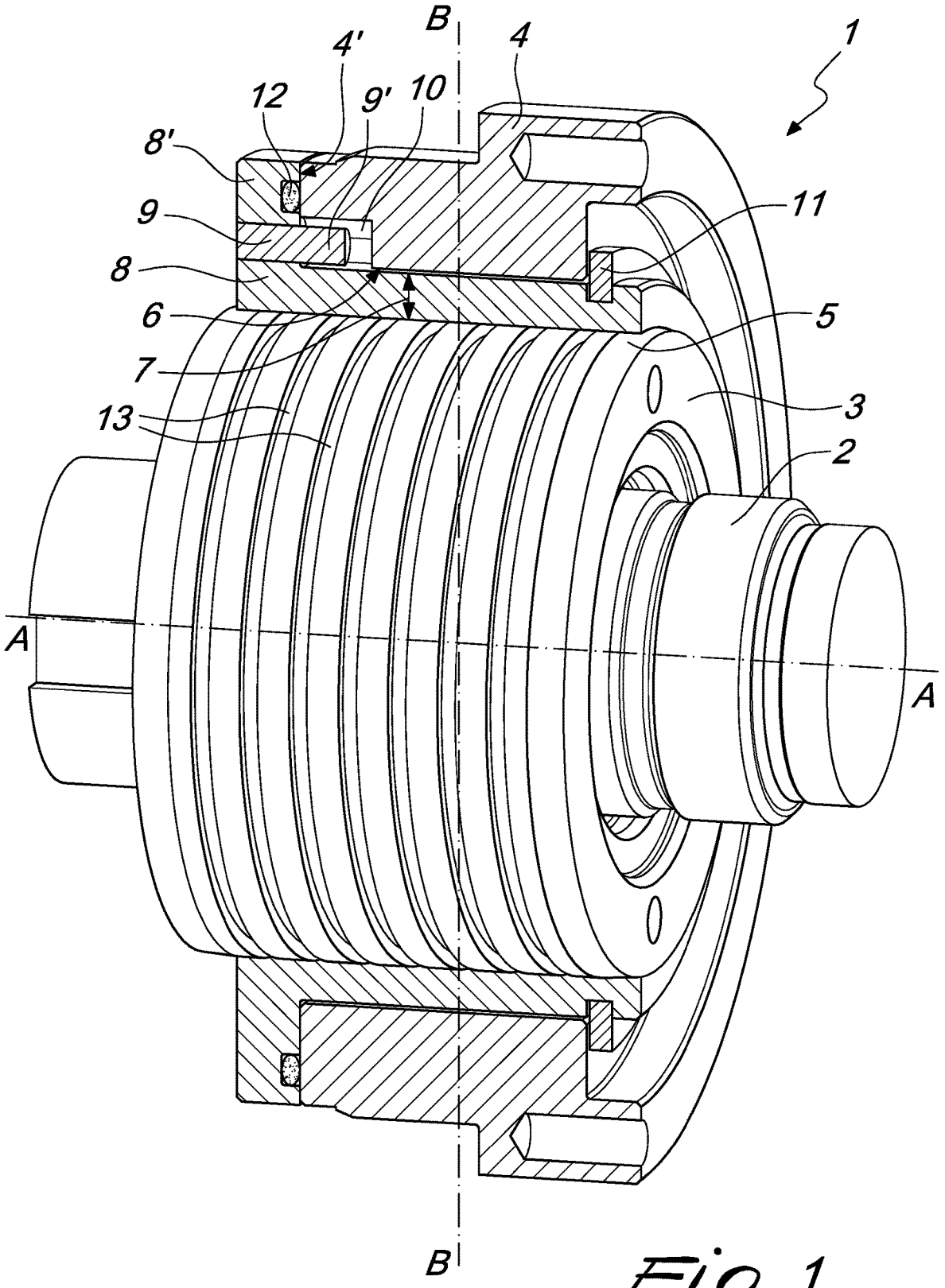
FIG. 1 is a cutaway perspective view showing the main components of a self-adjusting drum system for use with a pump, according to a first embodiment of the disclosure.

With reference to the above mentioned figures, the self-adjusting drum system according to the disclosure is generally designated with the reference numeral 1.

The system comprises, in a preferred but non exclusive embodiments thereof, a balancing drum 3 mounted on a central shaft 2 for joint rotation therewith. The balancing drum 3 has an outer surface 5.

The central shaft 2 extends along an axial direction shown in the Figure with a dotted line, marked A-A.

A fixed, stationary structure 4 surrounds the balancing drum 3.

The stationary structure 4 has its own inner surface 6 arranged to face the outer surface 5 of the balancing drum 3.

An annular gap 7 is provided between the inner surface 6 of the stationary structure 4 and the outer surface 5 of the balancing drum 3.

A bush element 8 is arranged in the annular gap 7 so as to leave a clearance with respect to the inner and outer surfaces 5, 6 or with respect either to the inner surface 6 or to the outer surface 5.

Fixing means for fixing the bush element 8 to the stationary structure 4 are furthermore provided. The fixing means are suitable to lock the bush element 8 against rotation movement and movement along the axial direction A-A, while allowing it to freely move along a radial direction inside said annular gap 7.

The radial direction is generally perpendicular to the axial direction A-A and is indicated in the Figure by the dotted line B-B.

The fixing means may comprise, according to the first embodiment shown in FIG. 1, a pin 9 and a radial slot 10 provided in the stationary structure 4.

The slot 10 has an extension, along the radial direction B-B, that is greater than the diameter of the pin 9, so that the pin 9 may radially move in the slot, back and forth in two directions.

The circumferential extension of the slot 10 is limited so that the pin 9 can prevent rotation movement of the bush element 8.

The fixing means further comprise a locking element 11 adapted to lock the bush element 8 to the stationary structure 4.

The locking element 11 can be provided, for example, as a circlip that is sprung or fixed into a groove provided on the radially external surface of the bush element 8.

Other locking elements may be provided, such as a ring that can be locked, in a known manner, onto the external surface of the bush element 8. Blocking pins can also be provided which are inserted in holes provided on the same external surface so as to prevent the axial movement of the bush element 8.

The pin 9 can be mounted, at an end of the bush element 8 that is opposite to the one where the locking element 11 is arranged and is provided with an end portion 9' which is suitable to protrude from the bush element 8.

In this way, the end portion 9' can be accommodated inside the radial slot 10 and is free to move back and forth inside it, in the radial direction B-B.

The pin 9 can be fixed to the end of the bush element in various ways. It can be fixed, for example, in a removable way by threading engagement, or by tight frictional engagement, by welding, riveting or in any other known suitable manner.

It can also be provided in one piece with the bush element 8.

With the above disclosed arrangement, the pin 9 and the locking element 11 can prevent the rotation movement and the movement of the bush element 8 along the axial direction A-A but not along the radial direction B-B.

The radial extension of the radial slot 10 is set so as to be at least equal to the clearance left in the annular gap 11 after insertion of the bush element 8.

The thickness of the bush element 8 is therefore selected to allow a clearance that has a size suitable to enable the radial movement of the bush element, pushed by the pressure of the fluid supplied by the pump, in a balanced intermediate position automatically set by virtue of the hydrostatic fluid pressure on the sides of the bush element 8.

Figure 2:
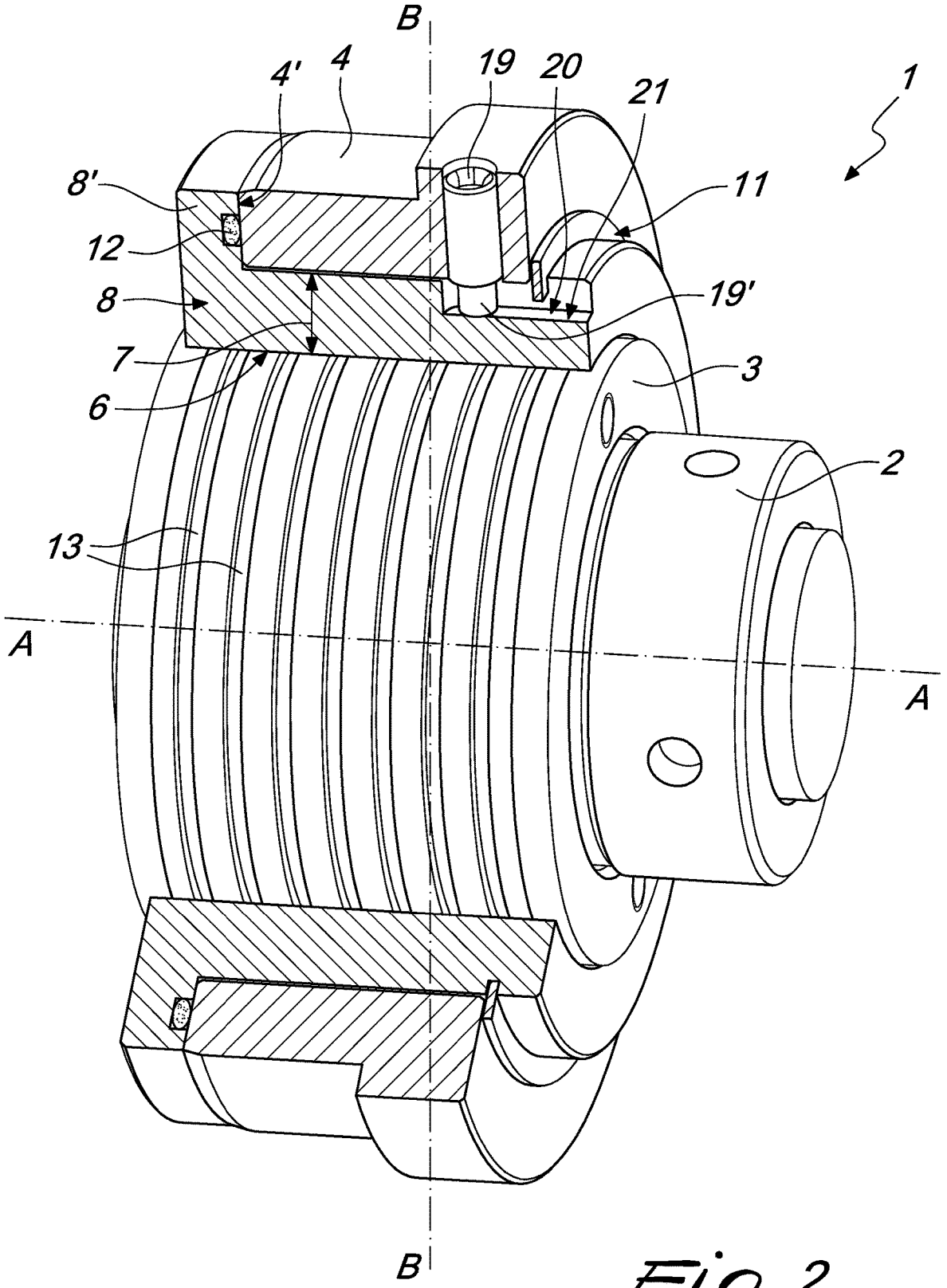
FIG. 2 is a cutaway perspective view showing the main components of a self-adjusting drum system for use with a pump, according to a second embodiment of the disclosure.

As illustrated in FIG. 2, the fixing means of the self-adjusting drum 1 also comprise, in a second embodiment thereof, a pin 19 that has an end portion 19'.

In this embodiment, an axial recess 20 is instead provided in the bush element 8 that faces the inner surface 6 of the stationary structure 4.

The axial recess 20 is made to have a depth extension, along the radial direction B-B, that extends up to a bottom part 21 of the recess 20.

The circumferential extension of the recess 20 is limited in this embodiment too, so that the pin 19 can prevent rotation movement of the bush element 8.

A locking element 11 is further provided, that is similar to that of the embodiment of FIG. 1 and is, here too, suitable to lock the bush element 8 to the stationary structure 4.

Locking elements with adapted different configurations, as set forth above for the first embodiment, can also be provided.

The pin 19 is arranged inserted radially through the stationary structure 4 to protrude with its end portion 19' in the axial recess 20, towards its bottom part 21.

This arrangement is such as to allow movement of the bush element 8 in the radial direction B-B.

The pin 19 and the locking element 11 are so suitable to prevent the rotation movement and the movement of the bush element 8 along the axial direction A-A but not along the radial direction B-B.

The arrangement of the axial recess 20 in the bush element 8 and the related positioning of the pin 19 so as to protrude in the recess can be any, as long as they do not interfere with, or hinder operation of the other elements of the drum system 1.

The depth extension of the axial recess 20 is provided bigger than the clearance allowed by the bush element 8 arranged in the annular gap 7.

The pin 19 is inserted in the fixed structure 4 with its end portion 19' protruding in the axial recess 20 up to a distance from the bottom part 21 that is at least equal to the clearance allowed by the bush element 8 when arranged in the annular gap 7.

Alternatively, the pin 19 may be inserted in the fixed structure with its end portion 19' reaching the bottom region 21 of the recess 20.

In this modified variant, the end portion 19' is provided so as to resiliently move in the radial direction B-B following to a pushing action of the bottom region 21 of the axial recess 20 against it.

The resilient movement of the end region 19' allows corresponding radial movement of the bush element 8.

In order to provide the resilient movement, allowing radial movement of the bush element 8, the pin 19 can comprise, for example, spring, pneumatic, hydraulic or other known suitable means adapted to provide the required resilient compliance at its end region 19'.

The bush element 8 is preferably made so as to have an L shape in cross section. This form is given by a lip portion 8' which protrudes radially from the body of the bush element 8.

The lip portion 8' is arranged to abut on a shoulder 4' provided at a corresponding end of the stationary structure 4.

Arrangement of the lip portion 8', in cooperation with the locking element 11, is adapted to prevent any axial movement of the bush element 8.

A sealing element 12, such as an O-ring or any other adapted gasket, suitable to seal the lip portion 8' to the shoulder (4') of the stationary structure 4, can also be provided.

The sealing element is intended to prevent fluid leakage from the annular gap 7, in particular between the inner surface (6) of the stationary structure (4) and the outer surface of the bush element (8). Such a leakage, if allowed, could inconveniently return to the high pressure side of the balance drum 3.

Dimensions and arrangement of the pin 9, 19 and of the slot 10 and recess 20, in the two embodiments, can be provided such that they can contribute too to prevent axial movement of the bush element 8.

Thus, for example, the end 9' of the pin 9, in the first embodiment of FIG. 1, can be made to reach near to the axial end of the slot 10.

In the second embodiment of FIG. 2, it is the circumferential surface of the body of the pin 19 that can made to reach near to the axial end of the recess 20.

The balancing drum 3 may be provided with a plurality of annular channels 13 that indent the outer surface 5 of the drum, so as to be in communication with said annular gap 7.

This structure is useful, for example, to create small pressure chambers that contribute to the bearing effect of the clearance, while helping to prevent excessive fluid flow rate through the gap.

In this case, the outer surface 5 of the drum 3 is defined by the upper surface of raised shoulders that divide the channels 13.

According to the disclosure, a multi-stage centrifugal pump is also provided which comprises the above-disclosed self-adjusting drum system.

In the pump, the central shaft 2 supports thereon an impeller.

Also, the stationary structure 4 can be provided by a fixed structure of the pump.

The fixed, stationary structure can be the pump casing or a part of it, such as a fixed, added, structural or functional element of the pump.

Pressurized fluid delivered by the pump inside the annular gap 7, formed between the outer surface 5 of the balancing drum 3 and the inner surface 6 of the stationary structure 4, arranges the bush element 8 in a hydrostatically centered position inside said annular gap 7.

This is made possible by way of the radial movement of the bush element 8, allowed by the pin end 9' moving inside the radial slot 10, pushed by fluid pressure force along the radial direction B-B.

The fluid pressure force can act on both sides of the bush element 8, since the clearance may form on both such sides.

A minimum, efficient clearance sufficient for the free rotation of the drum 3 is thus automatically provided which allows the formation of a thin film of fluid with high bearing capacities, while reducing to the minimum the fluid leakage through the allowed clearance.

Accordingly, an efficient and simple system is found by the present inventor to reduce the radial clearance between the balancing drum and the bushing arrangement, contrary to the general teaching of the known art.

This is achieved without lowering the bearing efficiency of the pump in which it is mounted and the efficiency of which is maintained practically unaffected.

It is important to note also that minimum leakage, high efficiency and highest possible bearing effect in the pump are obtained automatically, since a clearance setting at the side of the rotating drum is achieved by self-adjustment without any specific manual adjustment being required.

It has been found in practice that the disclosure fully achieves the intended advantages.

In practice the materials employed as well as the contingent size and shapes may be any, according to the requirements and the state of the art.

The invention claimed is:

1. A self-adjusting drum system for use with a pump, comprising:

a balancing drum mounted on a central shaft for joint rotation therewith, said shaft extending along an axial direction, said balancing drum having an outer surface thereof;

a fixed, stationary structure surrounding said balancing drum, said stationary structure having an inner surface arranged so as to face said outer surface of the balancing drum with an annular gap being provided therebetween;

a bush element arranged in said annular gap so as to leave a clearance with respect to said inner surface or said outer surface; and fixing means for fixing said bush element to said stationary structure so as to lock the bush element against rotation movement and movement along the axial direction and allow the bush element to freely move along a radial direction, inside said annular gap.

2. The self-adjusting drum system according to claim 1, wherein said fixing means comprise:

a pin;

a radial slot provided in said stationary structure and having an extension along said radial direction that is greater than a diameter of said pin; and a locking element;

said pin having an end portion and being arrangeable at an end of said bush element with said end portion protruding therefrom, said end portion being accommodateable inside said radial slot and free to move thereinside in the radial direction, and said locking element being suitable to lock said bush element to said stationary structure, whereby said pin and locking element are suitable to prevent the rotation movement and the movement of said bush element along said axial direction but not along said radial direction.

3. The self-adjusting drum system according to claim 1, wherein said fixing means comprise:

a pin having a pin end portion;

an axial recess provided in said bush element so as to face said inner surface of the stationary structure and having a depth extension along said radial direction up to a bottom part thereof; and a locking element;

said pin being inserted radially through said stationary structure to protrude with said pin end portion thereof in said axial recess, towards said bottom part, so as to allow movement of said bush element in said radial direction; and said locking element being suitable to lock said bush element to said stationary structure, whereby said pin and said locking element are suitable to prevent the rotation movement and the movement of said bush element along said axial direction but not along said radial direction.

4. The self-adjusting drum system according to claim 2, wherein radial extension of said radial slot is set so as to allow a movement of said end portion of the pin thereinside, along the radial direction, that is at least equal to said clearance.

5. The self-adjusting drum system according to claim 3, wherein said depth extension of the axial recess is bigger than said clearance.

6. The self-adjusting drum system according to claim 3, wherein said pin end portion protrudes in said axial recess up to a distance from said bottom part that is at least equal to said clearance.

7. The self-adjusting drum system according to claim 3, wherein said pin is provided so as to allow said pin end portion to resiliently move in said radial direction following to a pushing action of said bottom region of the axial recess thereagainst, whereby to allow corresponding radial movement of said bush element.

8. The self-adjusting drum system according to claim 1, wherein said bush element has, at a first end thereof, a lip portion that protrudes radially therefrom so as to abut on a shoulder of said stationary structure.

9. The self-adjusting drum system according to claim 8, wherein said locking element is mounted at a second end of said bush element.

10. The self-adjusting drum system according to claim 8, further comprising a sealing element suitable to seal said lip portion to said shoulder of said stationary structure so as to prevent fluid leakage from said annular gap.

11. The self-adjusting drum system according to claim 1, wherein said balancing drum has a plurality of annular channels indenting said outer surface thereof so as to be in communication with said annular gap.

12. A pump comprising the self-adjusting drum system according to claim 1, wherein the central shaft supports thereon an impeller of the pump, and the stationary structure is a casing or part of a casing of the pump.

13. The pump according to claim 12, wherein when pressurized fluid is flowed inside the annular gap formed between the outer surface of the balancing drum and the inner surface of the stationary structure, the bush element arranges itself in a hydrostatically centered position inside said annular gap by way of radial movement along said radial direction, so as to provide, during pump operation, minimum clearance sufficient for free rotation of the drum.

* * * * *